United States Patent [19]

Verjux

[11] 4,248,113

[45] Feb. 3, 1981

[54] CUTTER GUIDE DRIVE FOR CIGARETTE-MAKING MACHINE

[75] Inventor: Jean Verjux, Montgeron, France

[73] Assignee: Decoufle S.A.R.L., Paris, France

[21] Appl. No.: 60,233

[22] Filed: Jul. 24, 1979

[30] Foreign Application Priority Data

Jul. 24, 1978 [FR] France ..... 78 21827

[51] Int. Cl.[3] ..... A24C 5/28; B26D 1/56

[52] U.S. Cl. ..... 83/310; 83/327

[58] Field of Search ..... 83/310, 327, 328, 317

[56] References Cited

U.S. PATENT DOCUMENTS

| | | | |
|---|---|---|---|
| 3,440,912 | 4/1969 | Verjux | 83/310 |
| 3,728,923 | 4/1973 | Lanore | 83/310 X |
| 3,863,536 | 2/1975 | Legardinier | 83/310 X |

*Primary Examiner*—Frank T. Yost

*Attorney, Agent, or Firm*—Leydig, Voit, Osann, Mayer & Holt, Ltd.

[57] ABSTRACT

This cutter guide drive mechanism for cigarette-making machine is of the type wherein the cutter guide member is kept constantly parallel to itself while being rotatably driven at a tangential velocity equal to the linear velocity of the tobacco rod. The complete mechanism is housed in an oil-tight case consisting of one of the component elements of the cutter guide drive, whereby the mechanism is efficiently protected and can also be properly lubricated from inside.

3 Claims, 4 Drawing Figures

CUTTER GUIDE DRIVE FOR CIGARETTE-MAKING MACHINE

FIELD OF THE INVENTION

This invention relates to mechanisms for driving the cutter guide member of a machine for manufacturing continuous rods, notably for cigarette-making machines wherein the cutter guide member, rotating about an axis at a uniform tangential speed equal to the linear velocity of the tobacco rod, remains parallel to itself and perpendicular to said rod, and is carried by a coupling yoke comprising two bearings mounted on two crankpins of a pair of crankshaft or plates each provided with a crankpin of same radius, said yoke further comprising a third bearing at the vertex of an isosceles triangle of which the other two vertices are coaxial with said two bearings, respectively, said third bearing being mounted on the crankpin of a third crankshaft or plate of same radius as said two crankpins, said third plate being the only rotatably driven member of the assembly.

SUMMARY OF THE INVENTION

The cutter guide driving mechanism according to this invention is intended for assuring an improved protection and a more efficient lubrication of its component elements, which are all enclosed in a tight case constituting at the same time one of the component elements of the cutter guide drive which is specially designed for this purpose.

This result is obtained according to the present invention by providing a cutter guide drive of the type broadly set forth hereinabove which is further characterized in that the third crankpin crankshaft or plate consists of a rotary hollow body of which the front portion is shaped to constitute a bearing for the shaft having secured to its front or outer end the cutter guide member, the rear portion of this body being arranged to constitute another bearing enabling the body to revolve about a fixed shaft supporting the complete mechanism, the front end of this shaft having pivotally mounted thereon, within said hollow body, the first pair of crankpin plates having their crankpins engaged in the first pair of bearings of the coupling yoke, the two bearings of the third crankpin plate being off-set vertically from each other by a height equal to the radius of the three crankpins.

DESCRIPTION OF THE PREFERRED EMBODIMENT

Figure 1:
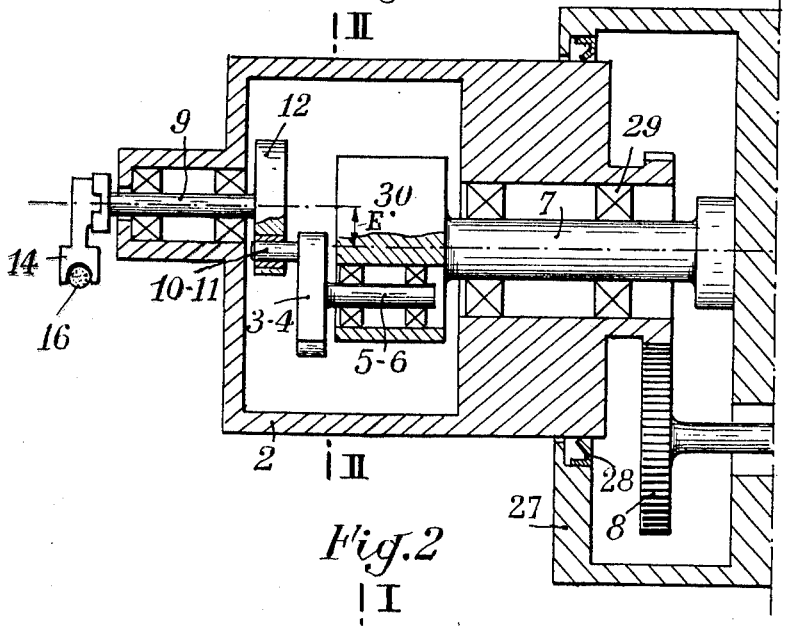
FIG. 1 is a longitudinal section taken along the broken line II—II of FIG. 2.
Figure 2:
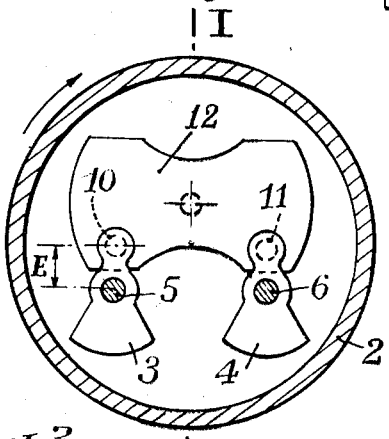
FIG. 2. is a cross section taken along the line II—II of FIG. 1.
Figure 3:
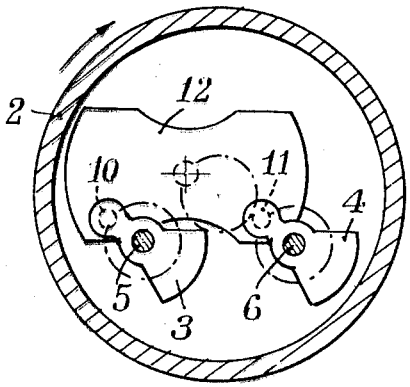
FIGS. 3 and 4 are views similar to FIG. 2 showing the component elements in different angular positions set off symmetrically in relation to the position shown in FIG. 2.
Figure 4:
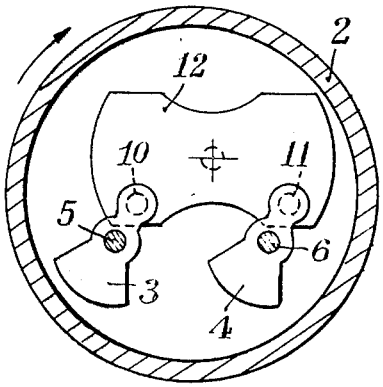

The cutter guide mechanism illustrated comprises an oil-tight case 2 enclosing the complete mechanism. This mechanism is adapted to be driven by a driving pinion 8 for rotation about the fixed shaft 7, this driving pinion 8 being enclosed in turn in a fixed casing 27 of which the front portion is apertured to permit the rotation therein of the rear portion of case 2 with the interposition of an annular seal 28. For this purpose, a bearing 29 provided in the rear portion of case 2 permits the mounting of the latter on the shaft 7.

At its front end, the shaft 7 has secured thereto, inside the case 2, a member 30 provided with a pair of symmetrical bearings in which shafts 5, 6 of a pair of balanced cranks 3, 4 are adapted to rotate about their respective shafts 10, 11. These cranks 3, 4 having the same throw "E" are journaled in symmetrical bearings of a common yoke 12.

The yoke 12 is secured on a shaft 9 the axis of which is at the apex of an isosceles triangle the other two corners of which are coincident with the respective axes of the two bearings. The shaft 9 is in a bearing of the case 2 which is offset from the axis of the shaft 7 by an amount equal to the throw "E" of the shafts 10 and 11. Shaft 9 has secured to its end a cutter guide member 14 which projects from the rotary case 2.

The case 2 is driven for rotation about the shaft 7 at a speed such that the tangential speed of shaft 9 is equal to the linear velocity of the continuous tobacco rod 16. The cutter guide member 14 remains constantly parallel to itself with the same movement as shaft 9 to the end of which it is secured. The yoke 12 is caused to oscillate by the action of the shafts 10 and 11 remaining constantly parallel when driven by identical torques from cranks 3 and 4 about their shafts 5 and 6 having a fixed position in the fixed member 30.

The complete mechanism is enclosed in the case 2 so that it is safely protected while affording a reliable lubrication thereof.

Of course, the specific form of embodiment of the invention which is described hereinabove with reference to the accompanying drawing should not be construed as limiting the present invention since various modifications may be brought thereto without departing from the basic principles of the invention, as will be clearly understood by those conversant with the art.

What we claim is:

1. A cutter guide drive for a cigarette-making machine having a cutter guide member carried on a shaft of a yoke having two bearings, each said bearing being mounted on a crankpin of a respective one of a pair of balanced cranks having the same throw, said shaft having its axis at the apex of an isosceles triangle of which the other two corners are coincident with the respective axes of the two bearings, said shaft forming the crankpin of a third crank having the same throw as said pair of cranks, said third crank being driven in rotation, whereby when in operation said cutter guide member moves in a plane parallel to itself at right angles to a continuous cigarette rod, and said cutter guide drive is located in an oil-tight case enclosing said yoke and said cranks.

2. The cutter guide drive according to claim 1 wherein said case is driven for rotation about a fixed shaft by a driving pinion enclosed in a fixed casing the front face of which is apertured for receiving the rear portion of said case and having a seal placed therebetween, and a bearing is provided in said rear portion of said case for mounting said case on said fixed shaft.

3. The cutter guide drive according to claim 2 wherein a member provided with a pair of symmetrical bearings is secured to the front end of said fixed shafts, said bearing receiving said shafts of said balanced cranks.

* * * * *